US011376871B2

(12) United States Patent
Iko

(10) Patent No.: US 11,376,871 B2
(45) Date of Patent: Jul. 5, 2022

(54) PRINTING APPARATUS, NOTIFICATION CONTROL METHOD AND STORAGE MEDIUM

(71) Applicant: CANON KABUSHIKI KAISHA, Tokyo (JP)

(72) Inventor: Takumi Iko, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 183 days.

(21) Appl. No.: 17/010,233

(22) Filed: Sep. 2, 2020

(65) Prior Publication Data

US 2021/0070071 A1 Mar. 11, 2021

(30) Foreign Application Priority Data

Sep. 5, 2019 (JP) ..... JP2019-162360

(51) Int. Cl.

| | |
|---|---|
| ***B41J 11/00*** | (2006.01) |
| ***B41J 29/19*** | (2006.01) |
| ***B41J 3/46*** | (2006.01) |
| ***B41J 13/10*** | (2006.01) |

(52) U.S. Cl.

CPC ..... *B41J 11/0095* (2013.01); *B41J 3/46* (2013.01); *B41J 11/006* (2013.01); *B41J 13/106* (2013.01); *B41J 29/19* (2013.01)

(58) Field of Classification Search

CPC ..... B41J 11/0095; B41J 3/46; B41J 11/006; B41J 13/106; B41J 29/19

See application file for complete search history.

(56) References Cited

U.S. PATENT DOCUMENTS

| | | | | |
|---|---|---|---|---|
| 8,783,859 | B2 * | 7/2014 | Tokisawa | B41J 11/006 347/104 |
| 10,728,414 | B2 * | 7/2020 | Sawai | H04N 1/0285 |
| 2011/0221850 | A1 * | 9/2011 | Kawaguchi | B65H 7/06 241/34 |

FOREIGN PATENT DOCUMENTS

| | | | |
|---|---|---|---|
| JP | 2007-106041 | A | 4/2007 |

* cited by examiner

*Primary Examiner* — Henok D Legesse

(74) *Attorney, Agent, or Firm* — Cowan, Liebowitz & Latman, P.C.

(57) ABSTRACT

A printing apparatus includes: a printing unit; a discharge unit configured to discharge a printed material on which the printing unit has performed printing and configured not to completely discharge but to hold the printed material; a detection unit configured to detect removal of the printed material that has been held by the discharge unit; and a control unit configured to control notification by a notification unit to a user. In response to detection by the detection unit of the removal of the printed material, the control unit is configured to control the notification unit to notify a user that the printed material has been removed.

15 Claims, 2 Drawing Sheets

PRINTING APPARATUS, NOTIFICATION CONTROL METHOD AND STORAGE MEDIUM

BACKGROUND OF THE INVENTION

Field of the Invention

The present disclosure relates to a printing apparatus, a notification control method and a storage medium.

Description of the Related Art

Small-sized printing apparatuses include those without a discharge tray for placing a recording medium (printed material) after printing is completed. In order to prevent discharged printed materials from being scattered around such a printing apparatus, there has been proposed a printing apparatus which does not discharge a printed material completely from the apparatus but hold it at a discharge slot (see Japanese Patent Laid-Open No. 2007-106041).

SUMMARY OF THE INVENTION

In a case where a printed material is not completely discharged but held, it will be difficult for a user to check a status of a printing process or the printed material. However, the printing apparatus proposed by the Japanese Patent Laid-Open No. 2007-106041 does not have a mechanism to notify a user of the status of the printing process or the printed material.

In light of the foregoing, it is desired to realize a mechanism to notify a user of a status of a printing process or a printed material in a printing apparatus that does not completely discharge a printed material but holds it.

According to an aspect, there is provided a printing apparatus including: a printing unit; a discharge unit configured to discharge a printed material on which the printing unit has performed printing and configured not to completely discharge but to hold the printed material; a detection unit configured to detect removal of the printed material that has been held by the discharge unit; and a control unit configured to control notification by a notification unit to a user. In response to detection by the detection unit of the removal of the printed material, the control unit is configured to control the notification unit to notify a user that the printed material has been removed.

Further features of the present invention will become apparent from the following description of exemplary embodiments (with reference to the attached drawings).

DESCRIPTION OF THE EMBODIMENTS

Figure 1A:
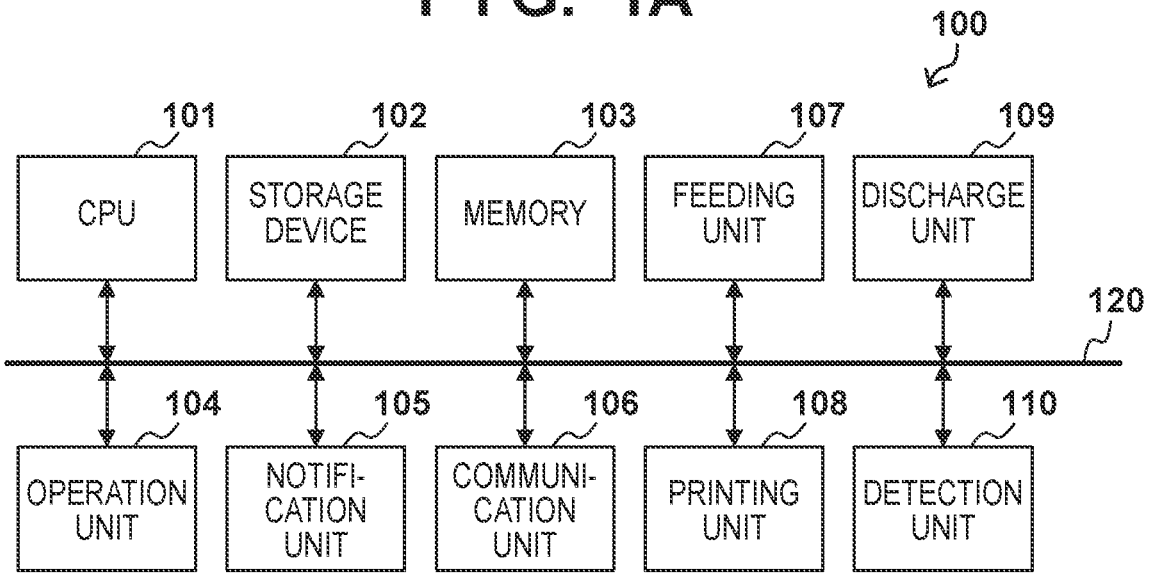
FIG. 1A is a block diagram illustrating an example of a configuration of a printing apparatus according to an embodiment.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate.

Furthermore, in the attached drawings, the same reference numerals are given to the same or similar configurations, and redundant description thereof is omitted.

1. CONFIGURATION OF APPARATUS

Figure 1B:
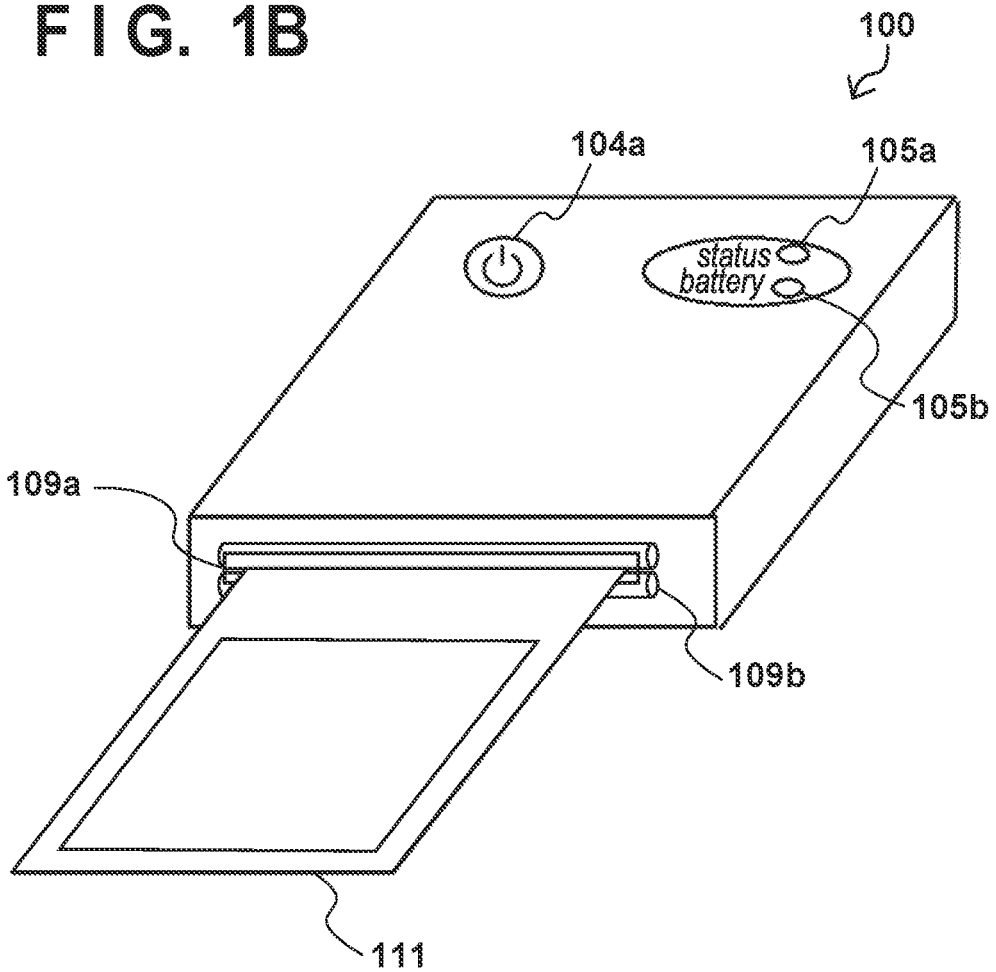
FIG. 1B is a schematic diagram illustrating an example of an outer appearance of a printing apparatus according to an embodiment.

FIG. 1A is a block diagram illustrating an example of a configuration of a printing apparatus 100 according to an embodiment. FIG. 1B is a schematic diagram illustrating an example of an outer appearance of the printing apparatus 100 according to the embodiment. Referring to FIG. 1A, the printing apparatus 100 includes a CPU 101, a storage device 102, a memory 103, an operation unit 104, a notification unit 105, a communication unit 106, a feeding unit 107, a printing unit 108, a discharge unit 109 and a detection unit 110. An internal bus 120 is a signal line which interconnects these elements of the printing apparatus 100.

The CPU (Central Processing Unit) 101 is a processor that controls general operations of the printing apparatus 100. The CPU 101, for example, controls each of the elements shown in FIG. 1A by executing a computer program, which is stored in the storage device 102 in advance and loaded onto the memory 103 for execution. The storage device 102 includes a non-transitory computer-readable storage medium and stores various programs and data used by the CPU 101. The memory 103 is used as a work memory by the CPU 101 and temporarily stores a program and data during operation of the printing apparatus 100.

The operation unit 104 receives an instruction or an information input from a user for the printing apparatus 100. For example, as illustrated in FIG. 1B, the printing apparatus 100 has a power supply button 104*a*. When the power supply button 104*a* is pressed, the operation unit 104 outputs, to the CPU 101, an input signal indicating that the power supply button 104*a* has been pressed. The CPU 101 interprets this input signal as an instruction for power-on or power-off of the printing apparatus 100, for example.

The notification unit 105 is a module that notifies a user of a status of the printing apparatus 100 (for example, a status of a printing process or a printed material) in accordance with control by the CPU 101. In the present embodiment, it is assumed that the notification unit 105 is configured to notify a user of various statuses using light. For example, as illustrated in FIG. 1B, the notification unit 105 has a first LED (Light-Emitting Diode) 105*a* and a second LED 105*b* as light-emitting units. The first LED 105*a* is used for notifying a user of a status of a printing process or a printed material. The second LED 105*b* is used for notifying a user of a status of a battery (not shown) of the printing apparatus 100. For example, the CPU 101 controls the notification unit 105 to emit light from the first LED 105*a* in accordance with any one of a plurality of predetermined notification patterns. The plurality of notification patterns are different from each other in at least one of blinking states (for example, light-on/blinking/light-off), blinking cycles (also referred to as blinking speed), blinking patterns and emission colors. A specific notification pattern is associated with a specific status of a printing process by the printing apparatus 100 or a specific status of a printed material discharged from the printing apparatus 100. A change in the notification patterns may also be considered as a kind of notification. Status notification performed by the notification unit 105 under control of the CPU 101 will be further described later. It should be noted that the number and types of light-emitting units of the notification unit 105 are not limited to the above-described examples.

It should be noted that, though FIG. 1B illustrates an example where the printing apparatus 100 is small-sized, portable and battery-powered apparatus, the example is not a limitation to the present embodiment. For instance, the printing apparatus 100 may be powered by a commercial power supply (AC power supply). The printing apparatus 100 may not have the second LED 105*b*.

Instead of (or in addition to) the above-described light emitting units, the status notification may be performed using a display unit (not shown) disposed inside or outside the printing apparatus 100. For example, the CPU 101 may control the notification unit 105 to display any one of a plurality of predetermined notification patterns (for example, icons or text messages) on a screen of an information processing apparatus that is connected to the printing apparatus 100 by wire or wirelessly. Instead of (or in addition to) the visual notification such as light emission or display, audible notification such as audio output (for example, alarm or speech output) or tactile notification such as vibration may be performed.

The communication unit 106 is a communication interface that facilitates communication by the printing apparatus 100 with external apparatuses. The communication unit 106 may, for example, receive image data for printing from an external apparatus via a network and output the received image data to the printing unit 108 in accordance with control by the CPU 101.

The feeding unit 107 is a module that feeds printing paper from a paper tray (not shown) that contain the printing paper to the printing unit 108 one by one.

The printing unit 108 prints an image represented by the image data for printing on a piece of paper fed by the feeding unit 107 in accordance with control by the CPU 101. In this specification, the piece of paper on which the printing unit 108 has performed printing is referred to as a printed material (regardless of whether the printing has been completed or not). As an example, the printing unit 108 may be a dye-sublimation printer unit. According to the dye-sublimation printing scheme, a printing operation is iteratively performed for each of a plurality of color materials. Thus, a printed material may be exposed to outside of the printing apparatus 100 during the printing process. However, the printing unit 108 may be a printer unit which adopts another printing scheme.

The discharge unit 109 is a module that discharges the printed material on which an image has been printed by the printing unit 108 from a discharge slot 109*a* of the printing apparatus 100 in accordance with control by the CPU 101. In the present embodiment, the discharge unit 109 has a discharge roller pair 109*b* (discharging member) as illustrated in FIG. 1B. The discharge roller pair 109*b* may also be utilized as a conveyance member that conveys a piece of paper during printing by the printing unit 108. The discharge unit 109 conveys the piece of paper by rotating the discharge roller pair 109*b* with the piece of paper nipped between the rollers. Upon completion of the printing by the printing unit 108, the printed material is discharged from the discharge slot 109*a* to outside of the printing apparatus 100. However, in order to prevent printed materials to be scattered, the discharge unit 109 does not completely discharge the printed material but holds the trailing edge of the printed material at the discharge roller pair 109*b* until it is removed by a user. A user can manually remove (for example, pull out) the printed material held at the discharge roller pair 109*b*.

The detection unit 110 is a sensor that detects whether a printed material is removed from the discharging member. For example, the detection unit 110 detects whether a printed material is held at the above-described discharge roller pair 109*b* and outputs the detection result to the CPU 101. In response to the detection by the detection unit 110 that a printed material has been removed, the CPU 101 may control the notification unit 105 to notify a user that the printed material has been removed. In a case where there is an uncompleted print job, the CPU 101 further causes the printing unit 108 to start a next printing operation in response to the detection by the detection unit 110 that a printed material has been removed. It should be noted that the uncompleted print job herein may include: the same print job having a page subsequent to a page for which printing has been completed; and another new print job. Note that a print job is a job that instructs image printing. Hence, when there is an uncompleted print job, it means that there remains an image that has not been printed (there is an image left to be printed). Similarly, when there is no uncompleted print job, it means that there no longer remains an image that has not been printed (there is no image left to be printed).

2. CONTROL OF STATUS NOTIFICATION

As described above, the printing apparatus 100 does not completely discharge but holds a printed material at the discharge slot. If a user does not remove the printed material, the printing apparatus 100 will not proceed with printing of a next page. Therefore, it will be beneficial if the printing apparatus 100 can timely notify a user of a status, such as whether the printed material has been appropriately removed.

In addition, in a case where the printed material remains held at the discharge slot even though printing has been completed, it will be difficult for a user to correctly recognize from when he or she can remove the printed material. In particular, an apparatus which exposes a printed material to the outside of the apparatus during printing operations may cause a risk for a user to misunderstand that the printing has been completed with the exposed printed material. In a case where the user accidentally tries to pull out the printed material before completion of the printing, the printing operation will be impeded and a trouble such as a printing failure, an operation error or a breakage may be caused.

Therefore, in the present embodiment, the CPU 101 of the printing apparatus 100 controls the notification unit 105 to notify a user of a status of a printing operation and a printed material in accordance with a notification pattern as described below.

<2-1. Various Notification Patterns>

(1) Notification Pattern P1: Notification of Printing Completed

The notification unit 105 performs notification to a user with a notification pattern P1 after the printing unit 108 completed printing and until the detection unit 110 detects that the printed material is removed from the discharging member. The notification pattern P1 is a pattern which indicates that the printed material is left at the discharging member. The notification pattern P1 may indicate as well that the printing has been completed. As an example, the notification pattern P1 may be a light emission pattern of the first LED 105*a* to blink in white more rapidly (in a shorter cycle) compared to the notification pattern P2 described later. In response to detection by the detection unit 110 that the printed material has been removed, the notification unit 105 ends the notification with the notification pattern P1.

The end of the notification pattern P1 (for example, a change to a notification pattern P4 described later) may be regarded as a notification to a user that the printed material has been removed.

(2) Notification Pattern P2: Notification of Executing Printing

The notification unit 105 performs notification to a user with the notification pattern P2, which is different from the notification pattern P1, during printing by the printing unit 108. The notification pattern P2 is a pattern which indicates that the printing is ongoing. As an example, the notification pattern P2 may be a light emission pattern of the first LED 105*a* to blink at a normal rate (in a longer cycle than the notification pattern P1) in white. In response to completion of the printing of each page, the notification unit 105 change the notification pattern P2 to the notification pattern P1 (or a notification pattern P3 described later). The change from the notification pattern P2 to such another notification pattern may be regarded as a notification to a user that the printed material has become removable.

(3) Notification Pattern P3: Alert for Removal

After the printing unit 108 completed printing and before the detection unit 110 detects that the printed material is removed from the discharging member, the notification unit 105 performs notification with the above-described notification pattern P1 if there is no uncompleted print job (that is, there is no image left to be printed). Meanwhile, the notification unit 105 performs notification with the notification pattern P3, which is different from the notification pattern P1, if there exists an uncompleted print job (that is, there is an image left to be printed). For example, in a case where printing of a page other than the last page of a print job for a plurality of pages has been completed, the above-described notification pattern P2 corresponding to notification of executing printing may be changed to the notification pattern P3 without going through the notification pattern P1. In a case where the printing apparatus 100 receives a new print job while performing notification with the notification pattern P1 (there remains a printed material that should be removed), the notification pattern P1 may be changed to the notification pattern P3. The notification pattern P3 is a pattern to alert a user that the next printing cannot be carried out because there remains the printed material that has not been removed. As an example, the notification pattern P3 may be a light emission pattern of the first LED 105*a* to blink in red. In particular, difference in light emission color between the notification pattern P3 and the other notification patterns can strongly prompt a user to remove the printed material, thereby the next printing can be started as early as possible. In other words, the notification pattern P3 (alert for removal) is a pattern which indicates that the printing has been completed and that printing of a next image as instructed by a print job cannot be started (unable to print) because a printed material has not been removed and is held.

(4) Notification Pattern P4: Notification of Standby

The notification unit 105 may perform notification with a notification pattern P4 when printing by the printing unit 108 is not going on and there remains no printed material to be removed. The notification pattern P4 is a pattern which indicates that the discharge unit 109 holds no printed material and next printing can be done by the printing unit 108. As an example, the notification pattern P4 may be a light emission pattern of the first LED 105*a* to light on in white. In a case where the printing apparatus 100 receives a new print job while notification with the notification pattern P4 is being performed, printing based on the print job will be immediately started by the printing unit 108. In order to enhance the effect of the above-described notification pattern P3 as an alert, it is beneficial to set light emission colors of the notification patterns P1, P2 and P4 to be the same as each other (for example, white) and a light emission color of the notification pattern P3 to be a different color (for example, red). For example, a difference in at least one of blinking states, blinking cycles and blinking patterns of the first LED 105*a* may be employed to distinguish between the notification patterns P1, P2 and P4.

(5) Notification Pattern P5: Notification of Printing Completed (Upon Power-on)

After the printing apparatus 100 is powered on, the notification unit 105 may perform notification with a notification pattern P5 in a case where the detection unit 110 detects that a printed material has not been removed from the discharge member. The notification pattern P5 indicates that a printed material is left at the discharging member as in the case of the notification pattern P1. The notification pattern P5 may be the same pattern as the notification pattern P1 or may be a different pattern than the notification pattern P1.

It should be noted that the above-described notification patterns are mere examples. Some of the above-described notification patterns may be omitted, two or more of the notification patterns may be merged and another notification pattern may be additionally introduced.

<2-2. Example of Process Flow>

Figure 2:
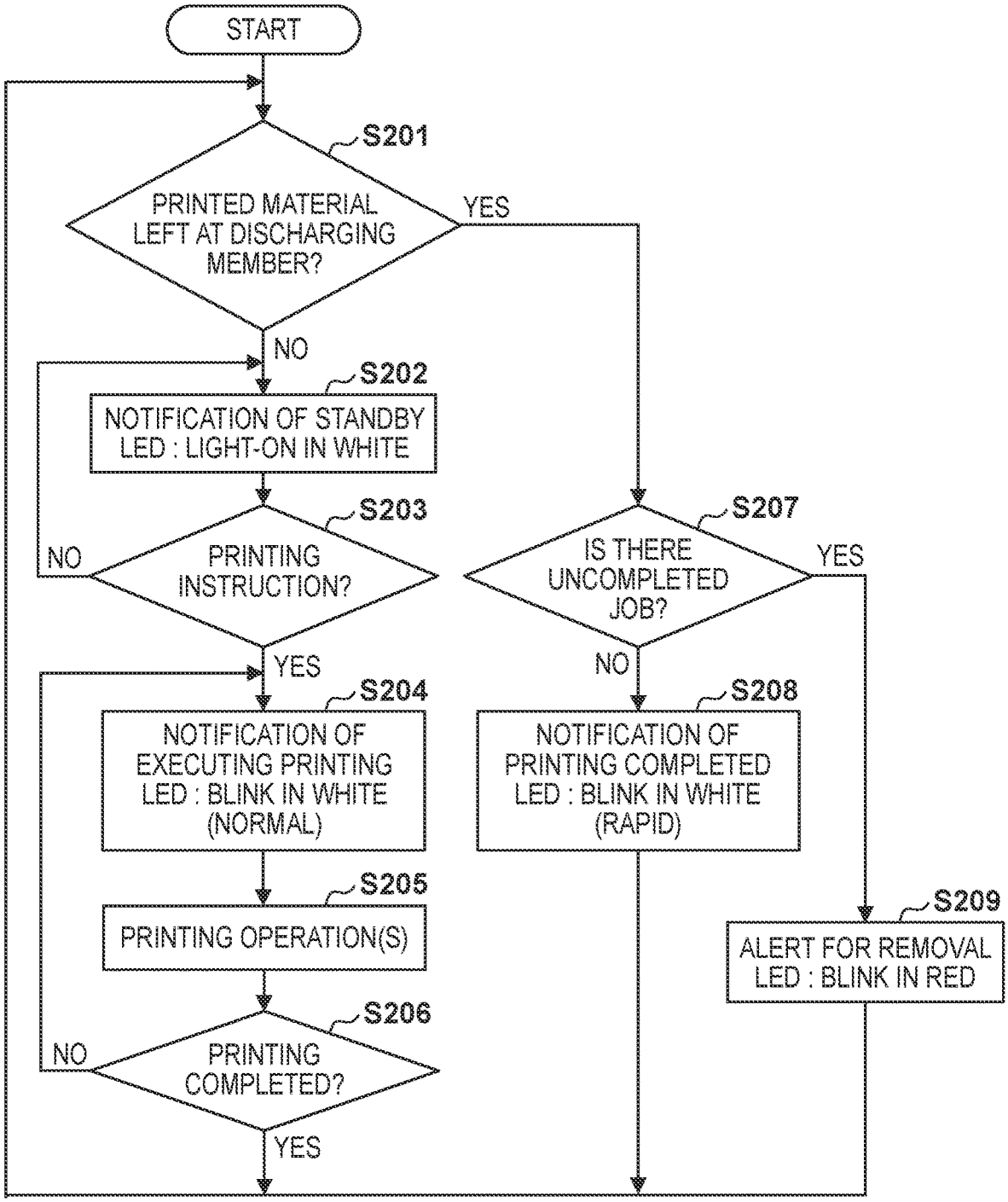
FIG. 2 is a flowchart illustrating an example of a flow of a notification control process according to an embodiment.

FIG. 2 is a flowchart illustrating an example of a flow of a notification control process that may be performed by the printing apparatus 100 according to the present embodiment. This notification control process may be initiated in response to the printing apparatus 100 being powered on by a user and repeated until it is powered off. Note that 'S (Step)' in the following descriptions is an abbreviation of 'process step'.

First, at S201, the detection unit 110 detects whether or not there remains a printed material that has not been removed from the discharge member. In a case where it is detected that there remains such a printed material, the process proceeds to S207. In a case where there remains no printed material, the process proceeds to S202.

At S202, the CPU 101 controls the notification unit 105 to perform notification of standby with the above-described notification pattern P4. For example, the first LED 105*a* lights on in white to indicate that the printing apparatus 100 is ready to start printing operation immediately.

While the notification unit 105 is performing the notification of standby, at S203, the CPU 101 waits for a printing instruction. A printing instruction may be received from an external apparatus via the communication unit 106. Upon detection of the printing instruction, the process proceeds to S204. If no printing instruction is detected, the notification of standby at S202 is continued.

At S204, the CPU 101 controls the notification unit 105 to perform notification of executing printing with the above-described notification pattern P2. For example, the first LED 105*a* blinks in white at a normal rate to indicate that the printing unit 108 is executing printing (thus, a user must not pull out the printed material).

S205 may be performed substantially in parallel to S204. While the notification unit 105 is performing the notification of executing printing, at S205, the CPU 101 causes the printing unit 108 to execute printing operation(s). The notification of executing printing and the printing operation(s) continue until the printing is determined to be completed at S206. For example, in a case where the printing apparatus 100 is a dye-sublimation printer, image transfers to a piece of paper with a plurality of color materials (for example, four colors of yellow, magenta, cyan and overcoat)

are sequentially performed per color material basis. The piece of paper reciprocates for the number of color materials in the printing apparatus 100 and a portion of the piece of paper may be partially exposed to outside from the discharge slot 109*a* between its motions. Upon completion of transfer with the last color material, the CPU 101 determines that the printing has been completed and the process proceeds to S201. At this point, the discharge unit 109 does not completely discharge the printed material but hold the trailing edge of the printed material at the discharging member. Immediately after the completion of printing, the printed material has not been removed yet and the process proceeds via S201 to S207.

At S207, the CPU 101 determines whether there exists an uncompleted print job or not. In a case where there exists no uncompleted print job, the process proceeds to S208. Meanwhile, in a case where there is an uncompleted print job, the process proceeds to S209.

At S208, the CPU 101 controls the notification unit 105 to perform notification of printing completed with the above-described notification pattern P1 because there exists no uncompleted print job but there remains a printed material to be removed. For example, the first LED 105*a* blinks rapidly in white to indicate that there is a printed material left at the discharging member. A user can recognize that the printed material has become removable based on the change from the notification pattern P2 (notification of executing printing) to the notification pattern P1 (notification of printing completed). In a case where the detection unit 110 detects removal of the printed material while the notification of printing completed with the notification pattern P1 is being performed at S208, the process proceeds to the branch of 'NO' at S201 and the notification of standby is performed at S202.

At S209, the CPU 101 controls the notification unit 105 to perform alert for removal with the above-described notification pattern P3 because there exists an uncompleted print job and there remains a printed material to be removed. For example, the first LED 105*a* blinks in red to indicate that the next printing cannot be carried out because there remains the printed material that has not been removed. A user can recognize that the printed material has become removable and that it is desirable to remove the printed material as soon as possible based on the change from the notification pattern P2 (notification of executing printing) to the notification pattern P3 (alert for removal). In a case where the detection unit 110 detects removal of the printed material while the alert for removal with the notification pattern P3 is being performed at S209, the process proceeds through S202 to the branch of 'YES' at S203 and the notification of executing printing is performed at S204. In parallel to the notification of executing printing, printing operation(s) are also performed at S205. In this case, the notification of standby at S202 may be skipped.

The notification of printing completed at S208 and the alert for removal at S209 will end if the detection unit 110 detects that the printed material has been removed from the discharging member at S201 and the notification pattern may change to the notification of standby at S202 (or the notification of executing printing at S204). A user can recognize for sure from this change that the removal of the printed material has been detected by the printing apparatus 100.

3. CONCLUSION

As above, embodiments of the present invention have been described in detail using FIGS. 1A, 1B and 2. According to the foregoing embodiments, in a printing apparatus which is configured not to completely discharge but to hold a printed material on which printing has been performed, notification to a user is performed in response to detection that the printed material has been removed. Such a configuration allows the user to timely recognize a status of removal of the printed material.

In the foregoing embodiments, during a period from completion of the printing to detection of the removal of the printed material, notification to a user may be performed with a first notification pattern that the printed material is left at the discharging unit. According to such a configuration, the user can correctly recognize the timing to remove the printed material from the printing apparatus 100 by being aware of the first notification pattern.

In the foregoing embodiments, while printing is ongoing, notification to a user may be performed with a second notification pattern that is different from the first notification pattern, and the second notification pattern may be changed to the first notification pattern in response to completion of the printing. According to such a configuration, a situation that a trouble is caused by the user accidentally trying to pull out the printed material before completion of printing will be suppressed by the notification with the second notification pattern. In addition, the user can quickly recognize by being aware of the change from the second notification pattern to the first notification pattern that the printed material has become removable in response to completion of the printing.

In the foregoing embodiments, after completion of the printing and before detection of the removal of the printed material, notification not with the first notification pattern but with a third notification pattern may be performed in a case where there is an uncompleted print job. According to such a configuration, a user can recognize presence of a subsequent page or a subsequent job from the difference between the first and third notification patterns, and it is possible to remove the printed material at an early timing especially when there exists the subsequent page or the subsequent job. Therefore, a probability of delay in printing operations as a whole by the printing apparatus 100 will be reduced.

In the foregoing embodiments, after the printing apparatus is powered on, notification to a user may be performed with a fourth notification pattern that may be the same as or different from the first notification pattern in a case where it is detected that a printed material has not been removed from the discharging unit. According to such a configuration, it is possible to promptly dissolve, by the notification to a user, a situation that a printing operation cannot be started due to the remaining printed material though the printing apparatus is powered on.

In the foregoing embodiments, an light-emitting unit may emit light in accordance with any one of a plurality of predetermined notification patterns where the plurality of notification patterns may be different from each other in at least one of blinking states, blinking cycles, blinking patterns and emission colors of the light-emitting unit. According to such a configuration, a user can recognize the status of the printing process (or the printed material) easily in a visual way without touching a printed material which might be possibly before completion of printing.

4. OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-162360, filed on Sep. 5, 2019 which is hereby incorporated by reference herein in its entirety.

What is claimed is:

1. A printing apparatus comprising:

a printing unit;

a discharge unit configured to discharge a printed material on which the printing unit has performed printing and configured not to completely discharge but to hold the printed material;

a detection unit configured to detect removal of the printed material that has been held by the discharge unit; and a control unit configured to control notification by a notification unit to a user, wherein in response to detection by the detection unit of the removal of the printed material, the control unit is configured to control the notification unit to notify a user that the printed material has been removed.

2. The printing apparatus according to claim 1, wherein in response to the detection by the detection unit of the removal of the printed material, the control unit is configured to control the notification unit to notify a user that next printing by the printing unit has become possible.

3. The printing apparatus according to claim 1, wherein the control unit is configured to control the notification unit to:

after the printing unit has completed the printing and until the detection unit detects the removal of the printed material from the discharge unit, perform notification with a first notification pattern that the printed material is left at the discharge unit; and in response to the detection by the detection unit of the removal of the printed material, end the notification with the first notification pattern to notify that the printed material has been removed.

4. The printing apparatus according to claim 3, wherein the control unit is configured to control the notification unit to:

in a case where the printing by the printing unit is ongoing, perform notification with a second notification pattern that the printing is ongoing, the second notification pattern being different from the first notification pattern; and in response to completion of the printing, change the second notification pattern to the first notification pattern to notify that the printed material has become removable.

5. The printing apparatus according to claim 3, wherein the control unit is configured to control the notification unit, after the printing unit has completed the printing and before the detection unit detects the removal of the printed material from the discharge unit, to:

perform notification with the first notification pattern in a case where there is no image left to be printed; and perform notification with a third notification pattern in a case where there is an image left to be printed, the third notification pattern being different from the first notification pattern.

6. The printing apparatus according to claim 3, wherein the control unit is configured to control the notification unit, after the printing apparatus has been powered on, to perform notification with a fourth notification pattern that the printed material is left at the discharge unit in a case where the detection unit detects that the printed material has not been removed from the discharge unit.

7. The printing apparatus according to claim 3, wherein the notification unit is a light-emitting unit that emits light in accordance with any one of a plurality of notification patterns, and the plurality of notification patterns are different from each other in at least one of blinking states, blinking cycles, blinking patterns and emission colors of the light-emitting unit.

8. The printing apparatus according to claim 1, wherein the printing unit is configured to sequentially perform printing operations with a plurality of color materials and the printed material is exposed from the discharge unit to outside between printing operations with different color materials.

9. The printing apparatus according to claim 8, wherein the printing apparatus is a dye sublimation printing apparatus.

10. The printing apparatus according to claim 1, wherein the control unit is configured to control the notification unit to:

in a case where the printing by the printing unit is ongoing, perform notification with a second notification pattern that the printing is ongoing;

in response to completion of the printing, perform notification with a first notification pattern that the printing has been completed and the printed material is held by the discharge unit; and in response to the removal of the printed material from the discharge unit, perform notification with a fifth notification pattern that the printed material is not held by the discharge unit and next printing by the printing unit has become possible.

11. The printing apparatus according to claim 10, wherein the control unit is configured to control the notification unit, in response to completion of the printing by the printing unit to:

perform notification with a third notification pattern that printing of an image that has not been printed cannot be started due to a printed material being held by the discharge unit in a case where there is an image left to be printed; and perform notification with the first notification pattern that the printed material is held by the discharge unit in a case where there is no image left to be printed.

12. The printing apparatus according to claim 11, wherein the notification unit is a light-emitting unit, and the third notification pattern is a pattern to cause the light-emitting unit to emit light in a different color than the first notification pattern.

13. The printing apparatus according to claim 11, wherein the notification unit is a light-emitting unit, the third notification pattern is a pattern to cause the light-emitting unit to emit light in a different color than the first notification pattern, the second notification pattern and the fifth notification pattern, and the first notification pattern, the second notification pattern and the fifth notification pattern are patterns to cause the light-emitting unit to emit light in the same color but different from each other in at least one of blinking states, blinking cycles and blinking patterns of the light-emitting unit.

14. A notification control method performed in a printing apparatus, comprising:

holding, by a discharge unit for discharging a printed material on which printing has been performed, the printed material without completely discharging the printed material;

detecting, by a detection unit, that the printed material has been removed from the discharge unit; and in response to detection by the detection unit that the printed material has been removed, controlling a notification unit to notify a user that the printed material has been removed.

15. A non-transitory computer-readable storage medium having stored therein a computer program for causing a printing apparatus, when executed by a processor of the printing apparatus, to:

hold, by a discharge unit for discharging a printed material on which printing has been performed, the printed material without completely discharging the printed material;

detect, by a detection unit, that the printed material has been removed from the discharge unit; and in response to detection by the detection unit that the printed material has been removed, control a notification unit to notify a user that the printed material has been removed.

* * * * *